US006540028B2

(12) United States Patent
Wood

(10) Patent No.: US 6,540,028 B2
(45) Date of Patent: Apr. 1, 2003

(54) AUTOMATIC CONDENSATE DRAIN DEVICE

(76) Inventor: James L. Wood, 257 Timber Creek Rd., Newport, WA (US) 99156

( * ) Notice: Subject to any disclaimer, the term of this patent is extended or adjusted under 35 U.S.C. 154(b) by 0 days.

(21) Appl. No.: 09/829,668

(22) Filed: Apr. 10, 2001

(65) Prior Publication Data

US 2002/0002995 A1 Jan. 10, 2002

Related U.S. Application Data

(60) Provisional application No. 60/196,110, filed on Apr. 11, 2000.

(51) Int. Cl.[7] ..... A62C 35/62
(52) U.S. Cl. ..... 169/17; 137/204; 137/545
(58) Field of Search ..... 137/204, 545; 169/17

(56) References Cited

U.S. PATENT DOCUMENTS

| | | | | |
|---|---|---|---|---|
| 2,627,869 A | * | 2/1953 | Whalen | 137/204 |
| 3,664,363 A | * | 5/1972 | Miyawaki | 137/183 |
| 4,269,217 A | * | 5/1981 | Flanagan et al. | 137/204 |
| 4,635,668 A | | 1/1987 | Netter | |
| 5,113,892 A | | 5/1992 | Hull et al. | |
| 5,361,795 A | | 11/1994 | Pollard | |
| 5,520,209 A | | 5/1996 | Goins et al. | |
| 5,842,499 A | | 12/1998 | Hall | |
| 5,975,114 A | | 11/1999 | Stahl et al. | |
| 5,979,488 A | | 11/1999 | Smith et al. | |
| 6,102,066 A | | 8/2000 | Craig et al. | |

* cited by examiner

*Primary Examiner*—Gerald A. Michalsky
(74) *Attorney, Agent, or Firm*—Harvey Kaye; Jerry Cohen; Perkins, Smith & Cohen, LLP

(57) ABSTRACT

A pressure operated normally closed control valve operates to open at a predetermined pressure between the system minimum and maximum pressures to open the valve and allow the discharge of condensate from the system which has a source of pressure to provide a minimum and a maximum pressure. The system is subject to the formation of condensate. There is an inline filter at the inlet end of the valve and a discharge nozzle at the outlet end of the valve. The entrance to the discharge nozzle may also have a filter. The assembly can also be arranged so that the control valve is normally open and operates to open at a predetermined pressure at or below the system minimum pressure whereby condensate is removed, and to close the valve and prevent the discharge of condensate from the system when the pressure falls below the predetermined pressure.

7 Claims, 2 Drawing Sheets

AUTOMATIC CONDENSATE DRAIN DEVICE

CROSS REFERENCE TO RELATED APPLICATIONS

This application claims the benefit of application Ser. No. 60/196,110 filed Apr. 11, 2000.

FIELD OF THE INVENTION

The present invention relates generally to the sprinkler art, and, more particularly to a condensate drain for a dry pipe sprinkler system.

BACKGROUND OF THE INVENTION

Automatic sprinkler systems include piping and devices to detect when a fire is occurring and automatically actuating to dispense water on the area where the fire is occurring sprinkler systems are basically made of the following components: a public water supply or a private water supply to supply water to the main riser; a main sprinkler riser equipped with control valves and alarm devices; the main sprinkler riser feeds water to sprinkler bulk mains that carry water throughout the building to sprinkler heads.

Sprinkler bulk mains, smaller cross-mains, and branch lines make up the piping network to supply individual sprinkler heads.

Thermally actuated water spray sprinkler heads are located throughout the area to be protected and are connected to the piping branch lines. In heated buildings the piping system is full of water under pressure and is ready to apply water to a fire whenever a sprinkler head opens.

In unheated buildings a special control valve (a dry-pipe valve) is installed in the sprinkler main riser. The dry-pipe valve keeps the piping system dry by holding back the water until a sprinkler head opens. The dry side of the control valve is filled with pressurized air.

In dry-pipe systems, when a sprinkler head opens, the air escapes faster than it can be replenished and the dry-pipe valve opens, filling the piping system with water and dispenses water on the fire.

Dry-pipe systems tend to collect condensate inside the piping system that must be periodically drained. If the condensate is not drained, freezing temperatures will cause ice to form in the piping system, causing the pipe and pipe fittings to burst.

In order to deal with this problem several solutions have been proposed.

U.S. Pat. No. 6,102,066 discloses a condensate drain for an automatic sprinkler system of the dry-pipe type in which there is an arrangement for periodic manual operation of valves to remove condensate. This system has a condensate reservoir with a valve at each end.

BRIEF SUMMARY OF THE INVENTION

It is an object of the present invention to provide for removal of condensate from dry pipe sprinkler systems.

It is another object of the present invention to provide for the discharge of such condensate automatically.

These objects and others are accomplished in accordance with preferred embodiments of the present invention. For example, a pressure operated normally closed control valve operates to open at a predetermined pressure between the system minimum and maximum pressures to open the valve and allow the discharge of condensate from the system which has a source of pressure to provide a minimum and a maximum pressure. The system is subject to the formation of condensate. There is an inline filter at the inlet end of the valve and a discharge nozzle at the outlet end of the valve. The entrance to the discharge nozzle may also have a filter. The assembly can also be arranged so that the control valve is normally open and operates to open at a predetermined pressure at or below the system minimum pressure whereby condensate is removed, and to close the valve and prevent the discharge of condensate from the system when the pressure falls below the predetermined pressure.

Other objects, features and advantages will be apparent from the following detailed description of preferred embodiments taken in conjunction with the accompanying drawings in which:

DETAILED DESCRIPTION OF THE DRAWINGS

Figure 1:
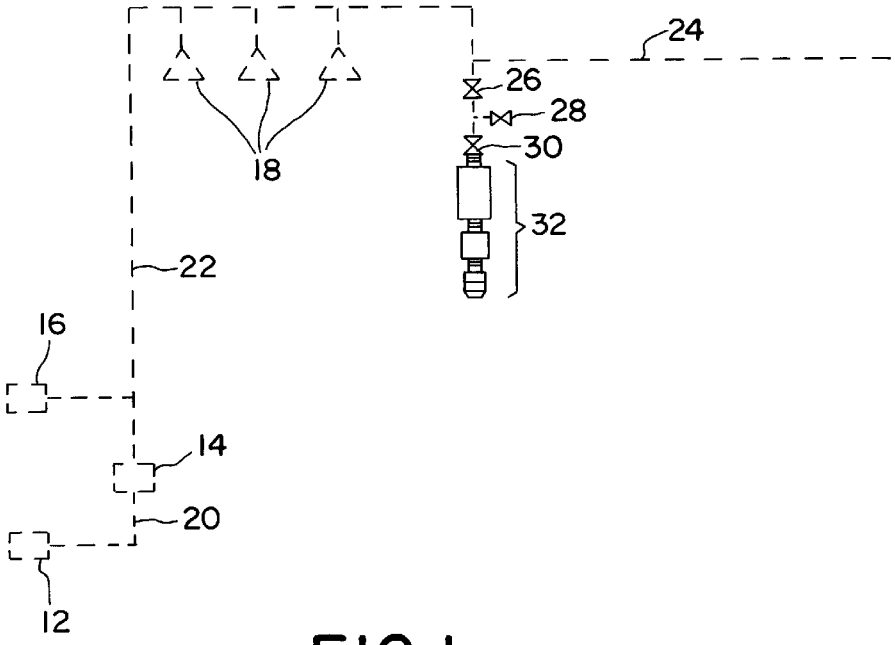
FIG. 1 is a schematic drawing of a typical dry-pipe sprinkler system showing the automatic condensate drain valve.

FIG. 1 shows a dry pipe sprinkler system including an underground water supply 12 connected to a supply pipe 20. A source of pressurized air 16 is connected to the pipe 20 so that when the fire sprinkler system control valve 14 is opened (as when a fire is sensed) the pressure delivers the water to the system which is normally dry. This then delivers water under pressure to pipe 22 which distributes the water to those sprinkler heads 18 which have sensed heat and called for water. There is a portion of the piping 24 which traps any condensate which forms in the system when water is not present (normal conditions) and a drain control valve 26 is connected to it. There is also a manual drain bypass 28 and a valve 30 to the automatic device. The automatic condensate drain device 32 is shown and, when actuated, drains any condensate which is present.

Figure 2:
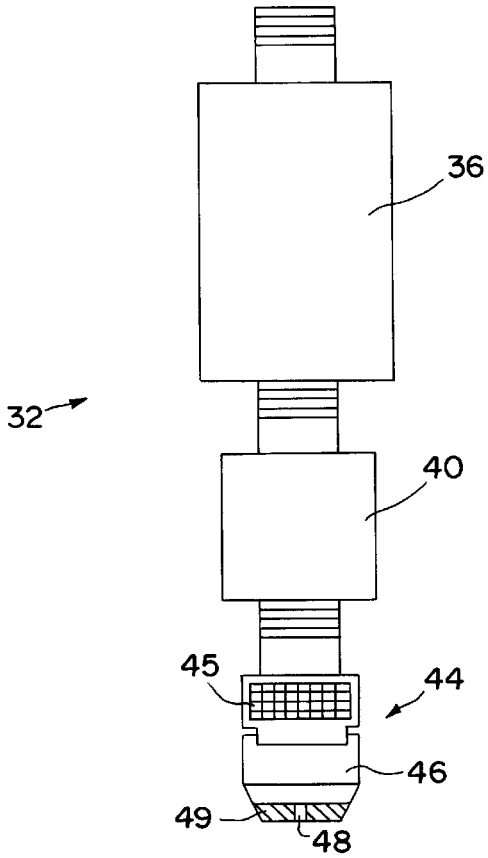
FIG. 2 is an elevation, partly in section, of the automatic condensate drain valve of the present invention.

The automatic condensate drain device 32 is shown in FIG. 2. An inline filter 36 is connected to a manual shutoff valve 30 (FIG. 1). The pressure operated control valve 40 is connected to filter 36. Connected to valve 40 is the nozzle body housing 44. Inside the body housing is a secondary filter 45 and a restricted discharge orifice 48 in an orifice plate 49. Both the secondary filter 45 and the restricted discharge orifice 48 have an O-ring or gasket between body housing, secondary filter and discharge orifice 48. Secondary filter 45 and restricted discharge orifice plate 49 are connected to the nozzle body housing 44 by the nozzle cap 46.

Figure 3:
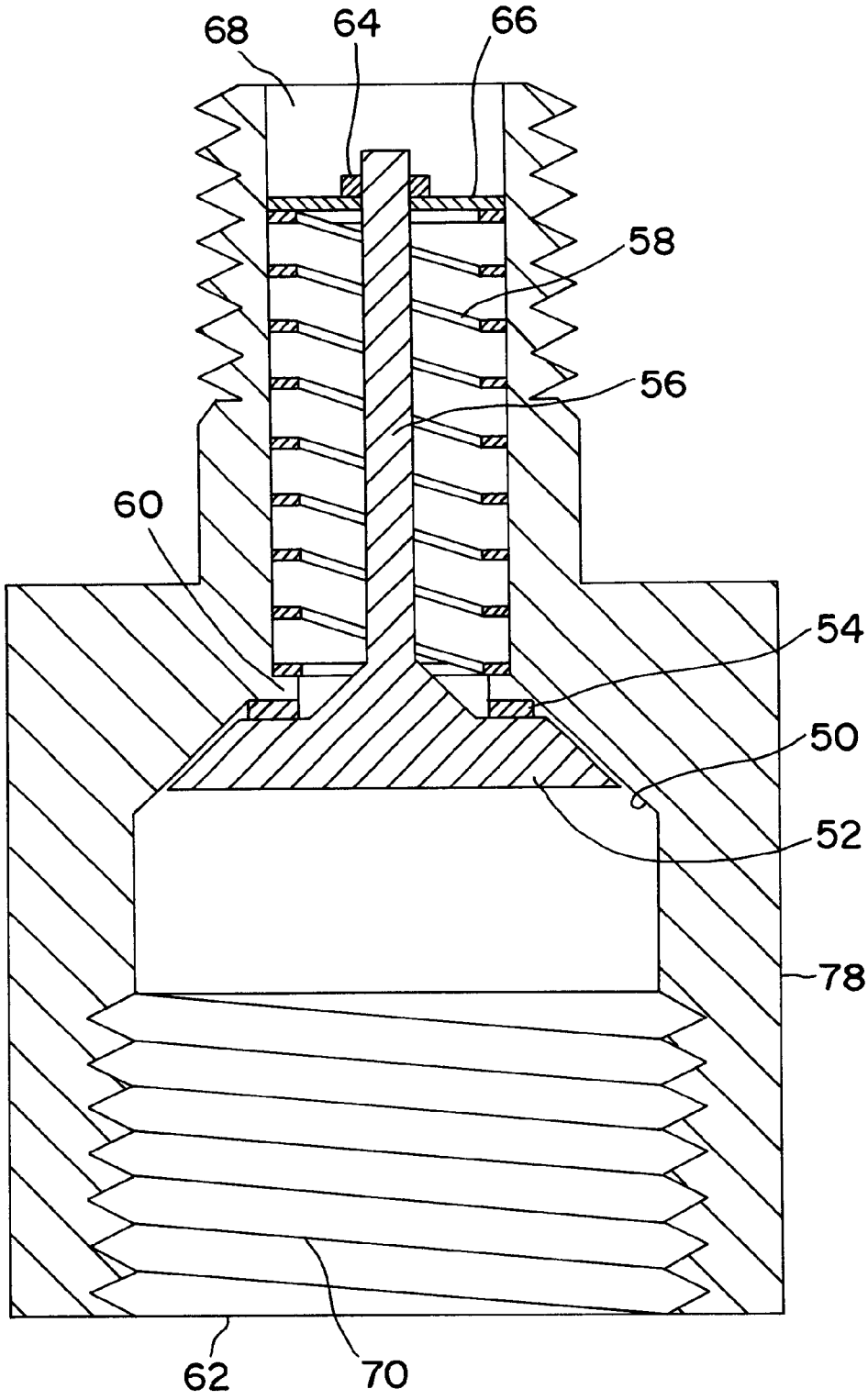
FIG. 3 is a cross section through the pressure operated control valve.

Further details of the pressure operated control valve 40 are shown in FIG. 3 which is a cross-section. There is a control valve body 48 having a valve seat 50 which is closed when valve element 52 moves against the seat 50. There is a rubber seal 54. The valve element has a valve stem 56 having threads to provide for adjustable spring tensionng and a locknut 64. The valve body 48 has an annular shoulder 60 above the valve seat 50 and which the valve element 52 may abut in its closed position. A rubber seal 54 is disposed below the shoulder and engages the top of the valve element when the element is in its closed position (the upper position as viewed in FIG. 3. There is a spring 58 disposed between the shoulder 60 and a spring tensioner 66 (which may be a disk) held onto the valve stem 56 by the locknut 64. The position of the spring tensioner 66 is changed by threading the locknut 64 downwardly to create greater spring tension and upwardly to create less spring tension. This determines the pressure which is required above the valve element 52 to open the valve.

Thus, one end of spring 58 rests on the opposite side of this shoulder from the valve outlet 62 and the other end of spring 58 rests against the spring tensioner 66 for controlling the amount of force needed to open the valve by moving the valve element 52 off of its seat 50. There is a control valve inlet 68, and female threads 70 inside the valve outlet 62.

Thus, the automatic condensate drain device of the present invention is intended to automatically drain condensed water from piping systems, or other containers which normally are free of water and filled with pressurized air or gas. In normal conditions condensed water, or air when water is not present, is discharged through the discharge nozzle until the air pressure drops to a predetermined level.

The device eliminates the need to manually drain small amounts of condensed water from piping systems or other containers.

The device has three principal components. An inline air filter 36 traps miscellaneous debris that may be in the piping system. An inline pressure operated control valve is utilized to shut the device off, if the air pressure drops below a desired limit. When sufficient air pressure is restored to the system the device will reset and automatically start operating.

A discharge nozzle controls the rate of discharge.

The device may be constructed primarily from off the shelf components. The particular size and parameters of the components are dependent upon the particular application requirements.

One example is a small system with an air compressor supplying 3 cfm of air to a system would utilize a 0.010 discharge orifice, 0.5 inch air filter, and 0.5 inch pressure operated control valve. In this system the inline air filter is a 40 micron filter and the secondary air filter is a 200 micron filter.

An example of an application is a piping system which is normally pressurized with air. An air compressor is automatically set to cut in at 30 psi and cut out at 40 psi, thereby maintaining 30 to 40 psi of air pressure at all times. The automatic drain device might be set to open above 35 psi and close when the pressure drops below 35 psi. Each time the compressor completes a 10 psi cycle, one half of the cycle will be automatically discharging condensed water or air.

In another arrangement, similar to the one described above, the automatic drain device can be set to open above 30 psi and close when the pressure drops below 30 psi. This will have this valve open during normal operation for continuous draining of condensate. However, if there is a loss of pressure, due to a malfunction or an emergency, then the valve will close as a safety feature so there will not be a loss of pressure.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. In an air pressurized, dry pipe fire sprinkler system having a source of air pressure normally operative to provide a minimum and a maximum pressure and a dry pipe valve which is normally closed to prevent water from a water supply from entering the sprinkler head piping until the pressure drops to a predetermined value which occurs when at leasts one of a series of sprinkler heads opens due to a rise in temperature to a predetermined value thereby opening the dry pipe valve so that water is delivered to the sprinkler head piping and to the sprinkler heads, the system being subject to the formation of condensate and having a condensate removal assembly, the improvement comprising:

an air pressure operated normally closed control valve which operates at a predetermined air pressure between the system minimum and maximum pressures to open said valve, and, while open cause the discharge of condensate from the system.

2. The improvement defined in claim 1, further comprising a discharge orifice at the outlet side of the control valve for regulating the amount of condensate which is discharged when the control valve is opened.

3. The improvement defined in claim 2, further comprising a filter at the inlet side of said discharge orifice.

4. The improvement defined in claim 2, further comprising an inline filter at the inlet end of said valve; and a discharge nozzle at the outlet end of said valve.

5. The improvement defined in claim 4, further comprising a filter at the inlet side of said discharge nozzle.

6. The improvement as defined in claim 1, further comprising:

an inline filter at the inlet end of said valve; and a discharge nozzle at the outlet end of said valve.

7. In an air pressurized, dry pipe fire sprinkler system having a source of air pressure normally operative to provide a minimum and a maximum pressure and a dry pipe valve which is normally closed to prevent water from a water supply from entering the sprinkler head piping until the pressure drops to a predetermined value which occurs when at least one of a series of sprinkler heads opens due to a rise in temperature to a predetermined value thereby opening the dry pipe valve so that water is delivered to the sprinkler head piping and to the sprinkler head, the system being subject to the formation of condensate and having a condensate removal assembly, the improvement comprising:

an air pressure operated normally open control valve which operates at a predetermined air pressure at or below the system minimum pressure whereby condensate is removed and to close said valve and prevent the discharge of condensate from the system when the pressure falls below said predetermined pressure.

* * * * *